US009683748B2

(12) United States Patent
Lord et al.

(10) Patent No.: US 9,683,748 B2
(45) Date of Patent: Jun. 20, 2017

(54) ROOFTOP HYDRONIC HEATING UNIT

(75) Inventors: Richard G. Lord, Murfreesboro, TN (US); Eugene D. Daddis, Jr., Manlius, NY (US); Kenneth J. Nieva, Baldwinsville, NY (US)

(73) Assignee: CARRIER CORPORATION, Farmington, CT (US)

( * ) Notice: Subject to any disclaimer, the term of this patent is extended or adjusted under 35 U.S.C. 154(b) by 640 days.

(21) Appl. No.: 14/003,705

(22) PCT Filed: Mar. 6, 2012

(86) PCT No.: PCT/US2012/027878
§ 371 (c)(1),
(2), (4) Date: Sep. 6, 2013

(87) PCT Pub. No.: WO2012/125342
PCT Pub. Date: Sep. 20, 2012

(65) Prior Publication Data

US 2013/0336642 A1 Dec. 19, 2013

Related U.S. Application Data

(60) Provisional application No. 61/451,841, filed on Mar. 11, 2011.

(51) Int. Cl.

| | |
|---|---|
| ***F24C 1/00*** | (2006.01) |
| ***F24C 11/00*** | (2006.01) |
| ***F24D 3/02*** | (2006.01) |
| ***F24H 3/06*** | (2006.01) |
| ***F24D 5/02*** | (2006.01) |
| ***F24D 5/04*** | (2006.01) |
| ***F24D 9/00*** | (2006.01) |

(52) U.S. Cl.
CPC ..... *F24D 3/02* (2013.01); *F24D 5/02* (2013.01); *F24D 5/04* (2013.01); *F24D 9/00* (2013.01); *F24H 3/065* (2013.01)

(58) Field of Classification Search
None
See application file for complete search history.

(56) References Cited

U.S. PATENT DOCUMENTS 3,938,348 A * 2/1976 Rickert ..... F24F 1/027 62/122
4,139,052 A * 2/1979 Lackey ..... F24F 1/02 165/137
4,242,876 A 1/1981 Cooper et al.
4,274,581 A * 6/1981 Hays ..... F24D 3/18 165/300

(Continued)

OTHER PUBLICATIONS

International Search Report from PCT/US12/027878 dated Jun. 17, 2013, pp. 1-4.

(Continued)

*Primary Examiner* — Thor Campbell
(74) *Attorney, Agent, or Firm* — Cantor Colburn LLP

(57) ABSTRACT

A rooftop air conditioning unit to provide conditioned air to a conditioned space within a building is provided and includes a housing, disposed on a roof of the building roof, defining a pathway from an inlet fed by exterior and/or interior air to an outlet leading to the conditioned space and a hydronic heating system disposed within the housing to heat the air traveling along the pathway.

16 Claims, 2 Drawing Sheets

(56) References Cited

U.S. PATENT DOCUMENTS 4,275,831 A 6/1981 Smith
4,399,862 A * 8/1983 Hile ..... F24F 11/0009 165/253
4,410,131 A 10/1983 Radtke et al.
4,426,037 A * 1/1984 Bernstein ..... F24H 1/287 122/18.4
4,640,458 A * 2/1987 Casier ..... F24H 6/00 126/101
4,727,728 A * 3/1988 Brown ..... B60H 1/00371 312/257.1
4,796,437 A * 1/1989 James ..... F24H 4/04 62/238.6
5,016,706 A 5/1991 Dimarco et al.
5,074,124 A * 12/1991 Chapman ..... F24F 5/0035 261/152
5,074,464 A * 12/1991 Moore, Jr. ..... F24H 6/00 126/101
5,239,838 A * 8/1993 Tressler ..... F24D 11/0221 237/2 B
5,305,614 A * 4/1994 Gilles ..... F24F 5/0096 62/238.7
5,351,502 A * 10/1994 Gilles ..... F24F 5/0096 62/238.7
5,423,187 A 6/1995 Fournier
5,752,389 A 5/1998 Harper
6,168,248 B1 1/2001 Timmons et al.
6,574,975 B2 6/2003 Bourne et al.
6,644,049 B2 11/2003 Alford
6,871,509 B2 3/2005 Grabon et al.
6,880,354 B2 4/2005 Reimann et al.
7,322,205 B2 1/2008 Bourne et al.
7,398,778 B2 * 7/2008 Kaiser ..... F24F 3/001 122/40
7,848,853 B2 * 12/2010 Milder ..... F24D 19/1051 126/561
2005/0006488 A1 * 1/2005 Stanimirovic ..... F24F 11/0086 236/49.1
2005/0056042 A1 * 3/2005 Bourne ..... F24F 3/044 62/310
2009/0113900 A1 5/2009 Lifson et al.
2010/0242507 A1 9/2010 Meckler
2012/0052786 A1 * 3/2012 Clawsey ..... F24F 7/065 454/229

OTHER PUBLICATIONS

Written Opinion from PCT/US12/027878 dated Jun. 17, 2013, pp. 1-7.

* cited by examiner

ROOFTOP HYDRONIC HEATING UNIT

CROSS REFERENCE TO RELATED APPLICATION

This application is a National Stage Application of PCT Application No. PCT/U.S. 12/27878 filed Mar. 6, 2012, which is a PCT Application of U.S. Provisional Patent Application No. 61/451,841 filed Mar. 11, 2011, the disclosures of which are incorporated by reference herein in their entireties.

BACKGROUND OF THE INVENTION

The subject matter disclosed herein relates to a rooftop unit and, more particularly, to a rooftop air conditioning unit to provide conditioned air to a conditioned space within a building.

Most modern buildings, especially large office buildings, hotels and residences, require substantial heating and cooling systems to maintain comfortable living and working conditions in their respective interiors. These systems often include rooftop units that are disposed on rooftops where ready supplies of inlet air can be found and negative issues associated with the noise and exhaust they generate can be mitigated.

Where the systems are configured to provide heating, the systems typically include tubular heat exchangers in which combustible materials are combusted within a tubular member and the heat from this combustion is transmitted directly to air surrounding the tubular member. This air is then transported to the interior of the corresponding building as heated air.

The existing tubular furnace designs can provide high air temperatures on a local level. In order to insure that these high air temperatures do not pose an ignition, safety and/or reliability risk, significant testing is required for all possible unit configurations. This testing requirement represents a significant cost and, if a particular design calls for an alternative unit configuration, the testing must be repeated or the unit configuration cannot be used.

BRIEF DESCRIPTION OF THE INVENTION

According to one aspect of the invention, a rooftop air conditioning unit to provide conditioned air to a conditioned space within a building is provided and includes a housing, disposed on a roof of the building roof, defining a pathway from an inlet fed by exterior and/or interior air to an outlet leading to the conditioned space and a hydronic heating system disposed within the housing to heat the air traveling along the pathway.

According to another aspect of the invention, a rooftop air conditioning unit is provided and includes a housing, disposed on a building roof, defining a pathway from an inlet fed by exterior and/or interior air to an outlet leading to a conditioned space within the building and a hydronic heating system disposed within the housing to heat the air traveling along the pathway.

According to yet another aspect of the invention, a rooftop air conditioning unit is provided and includes a housing, disposed on a building roof, defining a pathway from an inlet that is fed by exterior and/or interior air to an outlet leading to a conditioned space within the building, a heating element disposed within the housing to generate heat, a heat exchanger disposed within the housing and along the pathway to heat the air traveling along the pathway and a fluid supply circuit, which is fluidly coupled to the heating element and the heat exchanger, to transport fluid to the heating element, the fluid being heated by the heat generated therein, and to transport the fluid to the heat exchanger, the heated fluid heating the air traveling along the pathway.

These and other features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with features, by way of example with reference to the drawings.

DETAILED DESCRIPTION OF THE INVENTION

Figure 1:
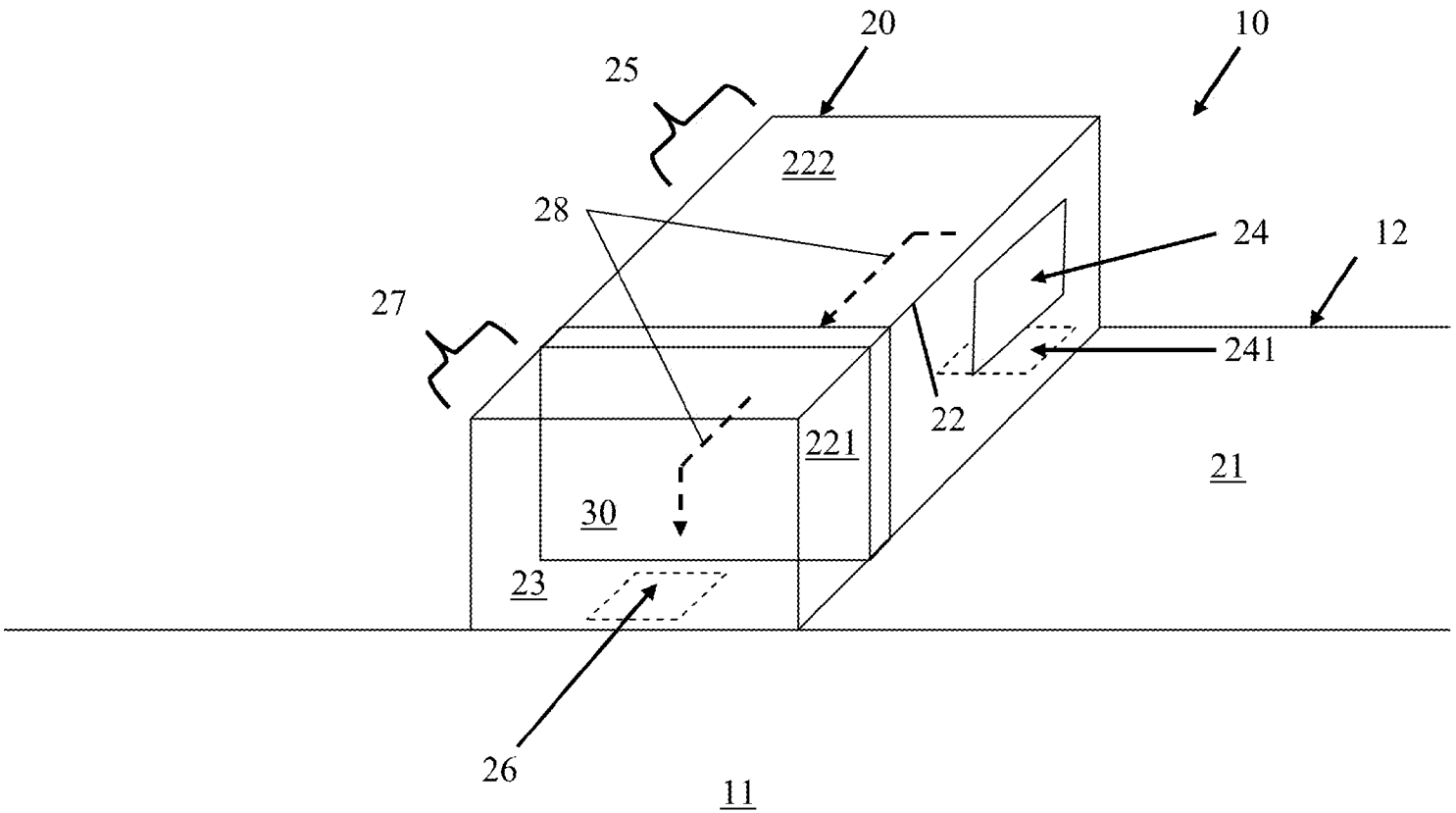
FIG. 1 is a perspective view of a rooftop air conditioning unit.
Figure 2:
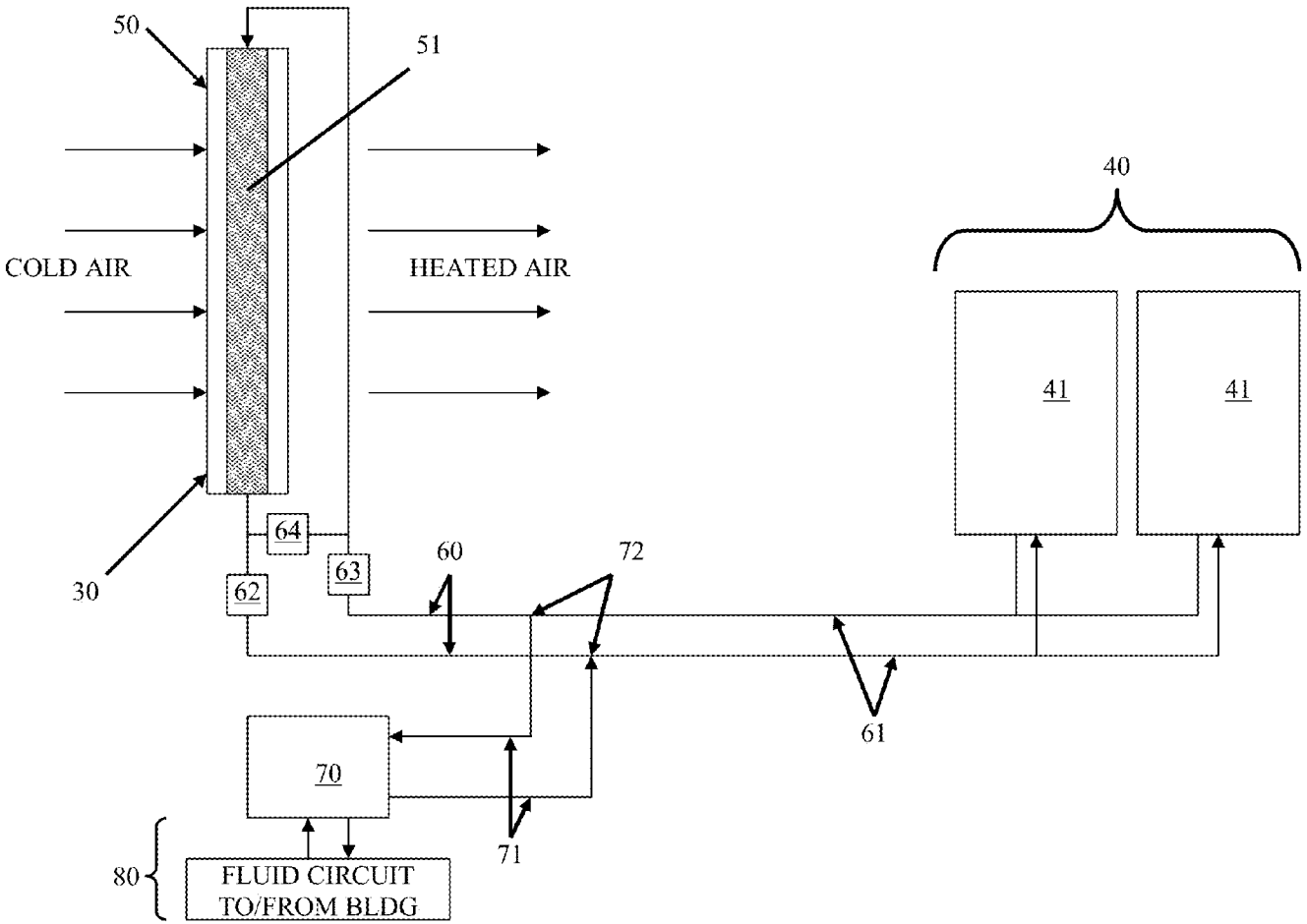
FIG. 2 is a schematic view of a fluid supply circuit for use with the rooftop air conditioning unit of FIG. 1.

With reference to FIGS. 1 and 2, a rooftop air conditioning unit 10 to provide conditioned air to a conditioned space 11 within a building 12 is provided. The rooftop air conditioning unit 10 includes a housing 20 and a hydronic heating system 30.

As shown in FIG. 1, the housing 20 is disposed on a roof 21 of the building 12 and includes an elongate body 22 having sidewalls 221 and an upper surface 222, which in concert with the roof 21 enclose an interior 23. Openings 24 and 241 are formed in the sidewalls 221, the upper surface 222 and a lower surface to define an inlet 25 through which exterior air and/or interior or return air enters the interior 23. A further opening 26 formed through the roof 21 defines an outlet 27 leading to the conditioned space 11. A pathway 28 is thereby defined from the inlet 25 through the interior 23 and to the outlet 27 along which air travels. This air may be blown by atmospheric conditions, an air circulation fan or a mechanical blower.

As shown in FIGS. 1 and 2, the hydronic heating system 30 is disposed within the housing 20 to heat the air traveling along the pathway 28 and includes a heating element 40 disposed within the housing 20 to generate heat, a heat exchanger 50 disposed within the housing 20 and along the pathway 28 to heat the air traveling along the pathway 28 and a fluid supply circuit 60. The fluid supply circuit 60 is fluidly coupled to the heating element 40 and the heat exchanger 50 and is configured to transport fluid, such as a closed supply of water or water mixed with another component, such as glycol, to the heating element 40 and to the heat exchanger 50. This fluid is heated by the heat generated in the heating element 40 and, at the heat exchanger 50, serves to heat the air traveling along the pathway 28.

In accordance with various embodiments, the heating element 40 may include one or more of a gas fired boiler and/or an electrically resistive element. In the case of the gas fired boiler, one or more boilers 41 may be supplied with fuel. This fuel may include natural and/or synthetic gas, hydrocarbon fuel, another similar fuel and/or some combination thereof The combustion of the fuel generates heat that heats the fluid, which in turn heats the air traveling along the pathway 28. That is, the fuel is decoupled from the air traveling along the pathway 28. Thus, optional fans, ductwork, filters, etc. for controlling airflow inside the housing 20 or the conditioned space 11 are separate from and are not limited by structural/mechanical features of the heating element 40 and, as such, different fan types and ductwork geometries can be employed without impacting performance of the boilers 41 and require no additional testing. The electrically resistive element may include an electric boiler, a hot water heater or another similar heating device.

The heat exchanger 50 may include any type of heat exchanger. In accordance with an embodiment, the heat exchanger 50 may include a coil 51 extending into and though the pathway 28. The heated fluid flows through the coil 51 and, as air traveling along the pathway 28 comes into contact with the coil 51, the heat in the fluid is transmitted to the air.

In accordance with further embodiments, the heated fluid may be limited to a predefined temperature, say 180 degrees Fahrenheit. As such, risk of an ignition source may be avoided and the heat exchanger 50 can be disposed within the housing 20 at a location upstream from an air circulation fan or a mechanical blower since risks associated with negative air pressures in this region can also be avoided.

The fluid supply circuit 60 may include piping 61, which is fluidly coupled to respective inlets and outlets of the heating element 40 and the heat exchanger 50, a pump 62 operably disposed along the piping 61 to urge fluid transport to the heating element 40 and the heat exchanger 50 and a pressure relief valve 63. The pressure relief valve 63 may be operably disposed along the piping 61 to control a pressure of fluid entering the heat exchanger 50 and may serve to prevent bursting in case of a dangerous pressure increase. A three-way valve 64 or a variable frequency drive may also be provided to control a temperature to which the air traveling along the pathway 28 is heated so that, for example, superheated fluid can be prevented from entering the heat exchanger 50 and posing an ignition risk.

Still referring to FIGS. 1 and 2, the rooftop air conditioning unit 10 may further include a secondary heat exchanger 70, which is disposed within the conditioned space 11, and a secondary fluid supply circuit 71. The secondary fluid supply circuit 71 is fluidly coupled to the heating element 40 and to the secondary heat exchanger 70 and is configured to transport a secondary fluid to the heating element 40 and to the secondary heat exchanger 70. The secondary fluid may therefore be heated by the heat generated in the heating element 40 and can be provided to the secondary heat exchanger 70 for secondary heat exchange within the conditioned space 11.

Where the secondary heat exchanger 70 and the secondary fluid supply circuit 71 are provided, the fluid and the secondary fluid may be isolated from one another in order to maintain the amounts of the fluid and the secondary fluid in each circuit. Such isolation can be provided by the use of valves, such as three-way valves 72, positioned upstream and downstream from the heating element 40. In an alternative embodiment, the valves may not be necessary with the fluid supply circuit 60 and the secondary fluid supply circuit 71 provided in parallel with one another. In still another alternative embodiment, the fluid and the secondary fluid may be permitted to be mixed with one another.

In accordance with aspects of the invention, the secondary heat exchanger 70 and the secondary fluid supply circuit 71 may be used to heat a perimeter of the conditioned space 11 of the building 12 and cool central portions of the conditioned space 11 substantially simultaneously by way of additional circuit 80, which flow to/from predefined portions of the building (i.e., the perimeter portions and/or the central portions) to/from the secondary heat exchanger 70. In accordance with embodiments, the secondary heat exchanger 70 may include a water-to-water heat exchanger disposed at the perimeter and connected to fluid supply circuit 60 whereby heated fluid flow to the heat exchanger 50 is reduced or cut off such that cool air is permitted to flow through the outlet 28 and heated fluid is transported from the heating element 40 to the secondary heat exchanger 70. In accordance with alternative embodiments, the secondary heat exchanger 70 may be proximate to the predefined portions of the building or remote from the predefined portions. In either case, the additional circuit 80 may be provided upstream and/or downstream from the secondary heat exchanger 70.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A rooftop air conditioning unit to provide conditioned air to a conditioned space within a building, comprising:

a housing, disposed on a roof of the building roof, defining a pathway from an inlet fed by exterior and/or interior air to an outlet leading to the conditioned space; and a hydronic heating system comprising:

a heating element disposed within the housing;

a heat exchanger disposed within the housing;

a fluid supply circuit comprising piping coupled to the heating element and the heat exchanger and a pump disposed along the piping to urge fluid heated by the heating element to be transported to the heat exchanger to heat the air traveling along the pathway;

a secondary heat exchanger disposed within the conditioned space;

valves disposed along the piping; and a secondary fluid supply circuit, which is fluidly coupled to the heating element via the valves and the piping and to the secondary heat exchanger, the secondary fluid supply circuit being configured to transport a secondary fluid to the heating element via the valves and the piping whereby the secondary fluid is heated by the heat generated therein and to transport the secondary fluid to the secondary heat exchanger for secondary heat exchange within the conditioned space.

2. The rooftop air conditioning unit according to claim 1, wherein the fluid and the secondary fluid are isolated from one another.

3. A rooftop air conditioning unit, comprising:

a housing, disposed on a building roof, defining a pathway from an inlet fed by exterior and/or interior air to an outlet leading to a conditioned space within the building; and a hydronic heating system disposed within the housing to heat the air traveling along the pathway, the hydronic heating system comprising:

a heating element disposed within the housing;

a heat exchanger disposed within the housing; and a fluid supply circuit comprising piping coupled to the heating element and the heat exchanger and a pump disposed along the piping to urge fluid heated by the heating element to be transported to the heat exchanger to heat the air traveling along the pathway prior to entering the heat exchanger in a first stage and to heat the air traveling along the pathway within the heat exchanger in a second stage.

4. The rooftop air conditioning unit according to claim 3, further comprising:

a secondary heat exchanger disposed within the conditioned space;

valves disposed along the piping; and a secondary fluid supply circuit, which is fluidly coupled to the heating element via the valves and the piping and to the secondary heat exchanger, the secondary fluid supply circuit being configured to:

transport a secondary fluid to the heating element via the valves and the piping whereby the secondary fluid is heated by the heat generated therein, and transport the secondary fluid to the secondary heat exchanger for secondary heat exchange within the conditioned space.

5. The rooftop air conditioning unit according to claim 4, wherein the fluid and the secondary fluid are isolated from one another.

6. A rooftop air conditioning unit, comprising:

a housing, disposed on a building roof, defining a pathway from an inlet that is fed by exterior and/or interior air to an outlet leading to a conditioned space within the building;

a heating element disposed within the housing to generate heat;

a heat exchanger disposed within the housing and along the pathway to heat the air traveling along the pathway; and a fluid supply circuit, comprising:

first piping which is fluidly coupled to the heating element to transport fluid to the heating element wherein the fluid is heated;

second piping which is fluidly coupled to the heat exchanger to transport the fluid heated by the heating element to the heat exchanger with the fluid heated by the heating element thermally interacting with and heating the air traveling along the pathway; and a pump disposed along the first piping to urge the fluid heated by the heating element to be transported to the heat exchanger, wherein the heating element comprises a first gas fired boiler fluidly coupled to the first piping at an inlet thereof and to the second piping at an outlet thereof and a second gas fired boiler fluidly coupled to the first piping at an inlet thereof and to the second piping at an outlet thereof.

7. The rooftop air conditioning unit according to claim 6, wherein the air traveling along the pathway is decoupled from gas consumed with in the boiler.

8. The rooftop air conditioning unit according to claim 6, wherein the heating element comprises an electrically resistive element.

9. The rooftop air conditioning unit according to claim 6, wherein the heat exchanger comprises a coil through which the heated fluid flows.

10. The rooftop air conditioning unit according to claim 6, wherein the fluid supply circuit comprises a pump to urge fluid transport to the heating element and the heat exchanger.

11. The rooftop air conditioning unit according to claim 6, wherein the fluid supply circuit comprises a pressure relief valve disposed along the second piping downstream from the first and second gas fired boiler to limit an amount of heated fluid transported to the heat exchanger.

12. The rooftop air conditioning unit according to claim 6, wherein the fluid comprises a closed supply of water.

13. The rooftop air conditioning unit according to claim 6, wherein the fluid comprises glycol.

14. A rooftop air conditioning unit, comprising:

a housing, disposed on a building roof, defining a pathway from an inlet that is fed by exterior and/or interior air to an outlet leading to a conditioned space within the building;

a heating element disposed within the housing to generate heat;

a heat exchanger disposed within the housing and along the pathway to heat the air traveling along the pathway; and a fluid supply circuit, comprising:

first piping which is fluidly coupled to the heating element to transport fluid to the heating element wherein the fluid is heated;

second piping which is fluidly coupled to the heat exchanger to transport the fluid heated by the heating element to the heat exchanger with the fluid heated by the heating element thermally interacting with and heating the air traveling along the pathway;

a pump disposed along the first piping to urge the fluid heated by the heating element to be transported to the heat exchanger;

a secondary heat exchanger disposed within the conditioned space;

a first valve disposed along the first piping downstream from the pump;

a second valve disposed along the second piping; and a secondary fluid supply circuit, which is fluidly coupled to the heating element via the first and second valves and the first and second piping and to the secondary heat exchanger, the secondary fluid supply circuit being configured to:

transport a secondary fluid to the heating element via the first and second valves and the first and second piping whereby the secondary fluid is heated by the heat generated therein, and transport the secondary fluid to the secondary heat exchanger for secondary heat exchange within the conditioned space.

15. The rooftop air conditioning unit according to claim 14, wherein the fluid and the secondary fluid are isolated from one another.

16. The rooftop air conditioner unit according to claim 14, wherein the outlet of the housing leads to a central portion of the conditioned space and the secondary heat exchange occurs at a perimeter of the conditioned space.

* * * * *